US008011473B1

(12) United States Patent
Gregersen

(10) Patent No.: US 8,011,473 B1
(45) Date of Patent: Sep. 6, 2011

(54) MOTORIZED STEPLADDER

(76) Inventor: Charles Gregersen, Gilbert, AZ (US)

( * ) Notice: Subject to any disclaimer, the term of this patent is extended or adjusted under 35 U.S.C. 154(b) by 376 days.

(21) Appl. No.: 12/244,951

(22) Filed: Oct. 3, 2008

Related U.S. Application Data

(60) Provisional application No. 60/986,009, filed on Nov. 7, 2007.

(51) Int. Cl.
*E06C 7/16* (2006.01)

(52) U.S. Cl. ..... 182/102; 182/101; 182/141; 187/240

(58) Field of Classification Search ..... 182/101, 182/102, 103, 69.6, 141, 186.6, 204, 90; 187/240, 242
See application file for complete search history.

(56) References Cited

U.S. PATENT DOCUMENTS

| | | | | |
|---|---|---|---|---|
| 2,880,920 | A * | 4/1959 | Glessner | 182/166 |
| 3,430,734 | A * | 3/1969 | Embree | 182/103 |
| 3,476,212 | A * | 11/1969 | Eakins | 182/103 |
| 3,799,289 | A * | 3/1974 | Cecere, Jr. | 182/145 |
| 4,049,081 | A * | 9/1977 | McDonald et al. | 182/148 |
| 4,258,826 | A * | 3/1981 | Murray | 182/20 |
| 4,427,094 | A * | 1/1984 | Winkelblech | 187/233 |
| 5,145,031 | A * | 9/1992 | Sprunger | 182/141 |
| 6,283,249 | B1 * | 9/2001 | Young et al. | 182/17 |
| 7,370,725 | B1 * | 5/2008 | Dornfeld | 182/2.2 |
| 2007/0267250 | A1 * | 11/2007 | Wolff | 182/103 |

* cited by examiner

*Primary Examiner* — Alvin Chin Shue
*Assistant Examiner* — Daniel Cahn
(74) *Attorney, Agent, or Firm* — Kenneth L Tolar

(57) ABSTRACT

A stepladder comprises a front frame and a rear frame each formed of a pair of spaced side rails. A motor-driven step is slidably mounted on the front frame side rails. The motor is controlled with a remote unit allowing a worker to automatically raise and lower the step when accessing an elevated area.

5 Claims, 2 Drawing Sheets

MOTORIZED STEPLADDER

CROSS REFERENCE TO RELATED APPLICATIONS

This application is entitled to the benefit of provisional application No. 60/986,009 filed on Nov. 7, 2007, the specification of which is incorporated herein by reference.

BACKGROUND OF THE INVENTION

The present invention relates to a ladder having a motorized step that can be automatically raised and lowered.

DESCRIPTION OF THE PRIOR ART

A stepladder includes multiple, tiered rungs that a worker sequentially climbs when accessing an elevated area. Usually, the worker must repeatedly ascend and descend the ladder, which is laborious and inconvenient. Furthermore, balancing on the narrow rungs while climbing the ladder or standing is tedious and unsafe. Accordingly, there is currently a need for a stepladder that is safer and easier to ascend and descend than conventional stepladders. The present invention addresses this need by providing a stepladder having a motorized step on which a worker stands that can be automatically raised and lowered.

SUMMARY OF THE INVENTION

A stepladder comprises a front frame and a rear frame each formed of a pair of spaced side rails. A motor-driven step is slidably mounted on the front frame side rails. The motor is controlled with a remote unit allowing a worker to automatically raise and lower the step when accessing an elevated area.

It is therefore an object of the present invention to provide a stepladder that is safer and easier to use than conventional stepladders.

It is another object of the present invention to provide a stepladder having a motorized step that may be automatically raised and lowered.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
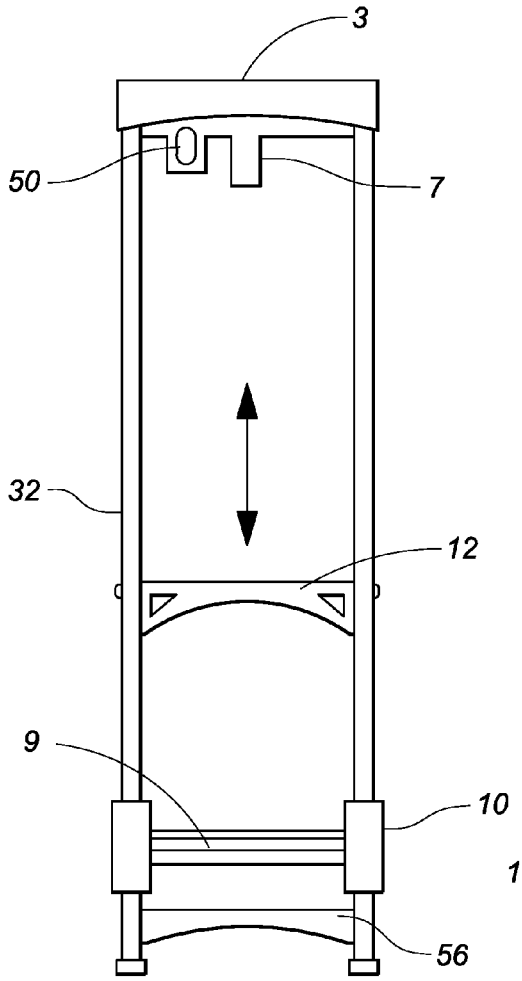
FIG. 1 is a front, plan view of the ladder according to the present invention.
Figure 2:
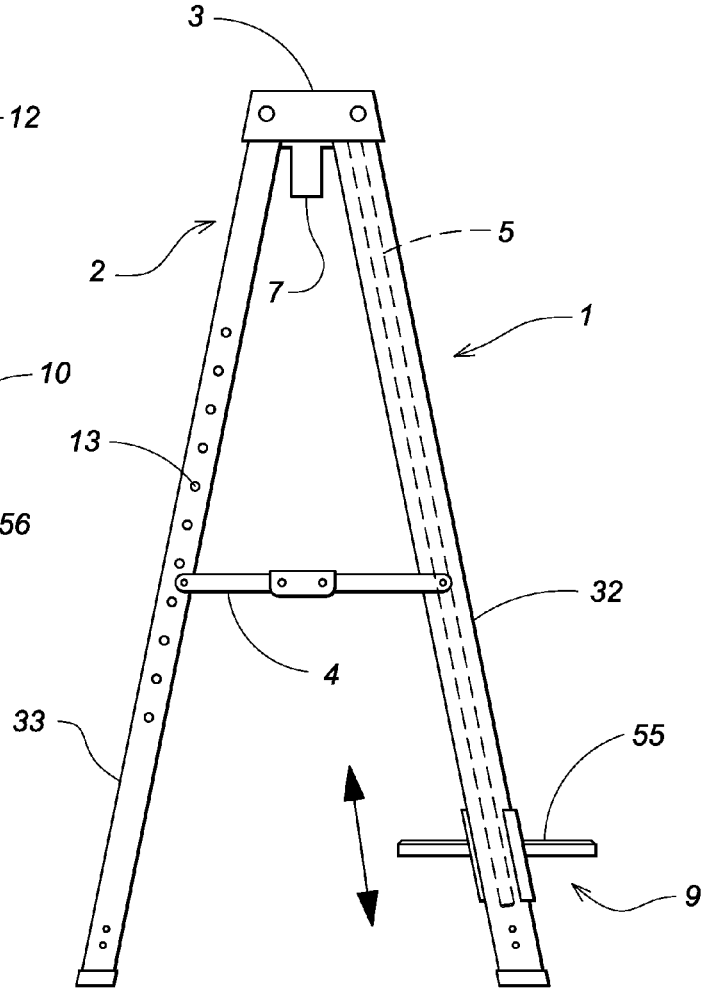
FIG. 2 is a side view of the ladder.
Figure 3:
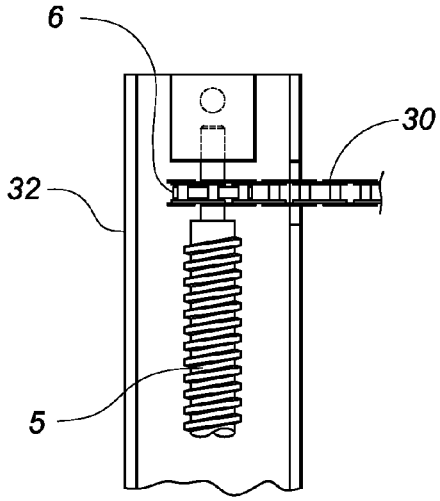
FIG. 3 is a detailed view of a drive screw and associated chain.
Figure 4:
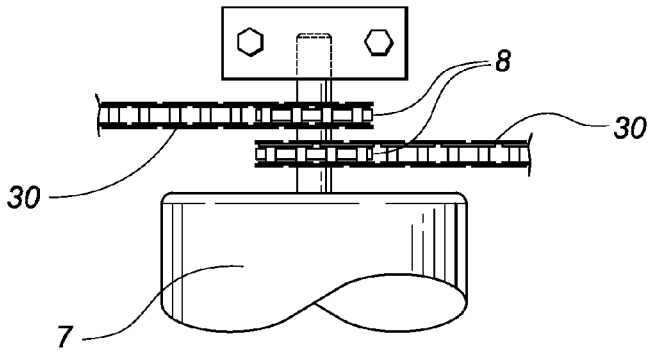
FIG. 4 is a detailed, cutaway view of the motor and associated sprockets.
Figure 5:
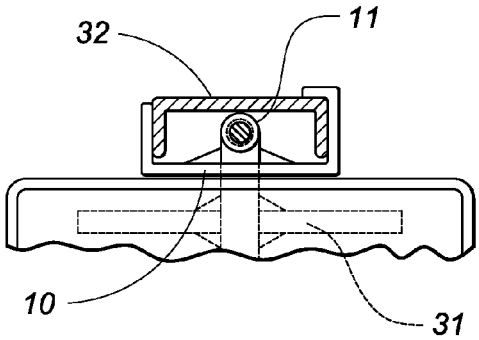
FIG. 5 is a detailed view of the bearing assembly.
Figure 6:
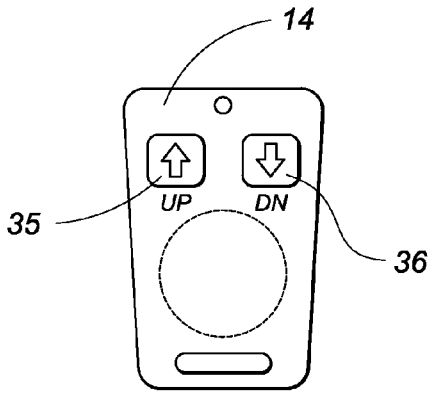
FIG. 6 depicts the remote unit.

A stepladder comprises a front frame 1 and a rear frame 2 each formed of a pair of spaced side rails 32,33. A cover 3 is superimposed on the top ends of the frames while a pair of expandable brace members 4 extend between intermediate portions, similar to a conventional stepladder; as with many conventional stepladders, the cover includes recesses and apertures for receiving paint cans, tools, light bulbs and similar items; the brace members allow the frame members to expand to a substantially V-shaped configuration when the ladder is in use, or to contract to a substantially linear configuration for storage.

Axially received within each front frame member side rail 32 is an elongated drive screw 5 having a drive gear 6 at a top end thereof. Positioned within the cover 3 is a reversible motor 7 and an associated rechargeable battery 50; the motor drives a pair of sprockets 8 in either of two directions. A designated chain 30 encompasses one of the drive gears 6 and one of the sprockets 8 so that operation of the motor results in simultaneous rotation of the drive screws 5.

Slidably mounted on the front frame side rails 32 is a step 9 on which a worker stands when accessing an elevated area. The step includes a substantially C-shaped bearing member 10 at each of two opposing sides thereof; each bearing member encompasses one of the front frame side rails 32 so that the step remains level as it moves along the frame. Within each bearing is a threaded drive nut 11 that receives one of the drive screws 5 such that rotation of the screw results in axial translation of the step. Overlaying the upper surface of the step is a pliable, slip-resistant layer 55 that provides a comfortable, frictional surface on which a worker stands. A brace 31 is secured to the lower surface of the step to enhance the structural integrity thereof.

An adjustable stabilization bar 12 is disposed between the rear frame side rails 33. The bar 12 includes spring-biased locking pins that seat within apertures 13 on the side rails 33 to fix the bar at a select height. A fixed stabilization bar 56 is positioned between both the rear and front frame side rails to enhance the overall structural integrity of the ladder. The motor is controlled with a wireless remote unit 14 that includes an UP button 35 and a DOWN button 36 allowing a worker to easily raise or lower the step by simply depressing the appropriate button. The remote unit preferably includes a cable or chain that tethers it to the ladder.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A stepladder comprising:

a frame member formed of a front frame and a rear frame, said front frame having a first side rail and a second side rail, said first side rail and said second side rail each including a top end, an intermediate portion and a lower end;

a step mounted on said front frame;

a first drive screw received within said first side rail, said first drive screw having a first drive gear attached thereto;

a second drive screw received within said second side rail, said second drive screw having a second drive gear attached thereto;

a drive nut attached to each of two opposing sides of said step, each nut receiving either of said first drive screw and said second drive screw;

a reversible motor attached to said frame member;

a first sprocket and a second sprocket operably connected to said motor;

a first chain encompassing said first sprocket and said first drive gear;

a second chain encompassing said second sprocket and said second drive gear whereby operation of the motor results in simultaneous rotation of the first drive screw and the second drive screw to move the step along said front frame.

2. The stepladder according to claim 1 wherein said step includes a substantially C-shaped bearing member at each of two opposing sides thereof, each bearing member encompassing either of said first side rail and said second side rail so that the step remains level as the step moves along the front frame.

3. The stepladder according to claim 2 further comprising:

said rear frame formed of a third side rail and a fourth side rail;

a stabilization bar disposed between said third side rail and said fourth side rail, said stabilization bar having two opposing ends, each of said ends having spring-biased locking pins thereon that seat within apertures on said third side rail and said fourth side rail to fix the stabilization bar at a select height.

4. The stepladder according to claim 3 further comprising a brace secured to a lower surface of said step to structurally enhance said step.

5. The stepladder according to claim 4 further comprising a remote unit in wireless communication with said motor, said remote unit including a pair of control buttons that allow a worker to easily raise and lower the step by simply depressing one of said buttons.

* * * * *